US010563669B2

(12) United States Patent
Sakoda et al.

(10) Patent No.: US 10,563,669 B2
(45) Date of Patent: Feb. 18, 2020

(54) FAN AND AIR-CONDITIONING DEVICE

(71) Applicant: Mitsubishi Electric Corporation, Chiyoda-ku (JP)

(72) Inventors: Kenichi Sakoda, Chiyoda-ku (JP); Tomoya Fukui, Chiyoda-ku (JP); Masayuki Oishi, Chiyoda-ku (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 160 days.

(21) Appl. No.: 15/578,291

(22) PCT Filed: Apr. 8, 2016

(86) PCT No.: PCT/JP2016/061576
§ 371 (c)(1),
(2) Date: Nov. 30, 2017

(87) PCT Pub. No.: WO2017/026143
PCT Pub. Date: Feb. 16, 2017

(65) Prior Publication Data

US 2018/0142704 A1 May 24, 2018

(30) Foreign Application Priority Data

Aug. 10, 2015 (JP) ..... 2015-158287

(51) Int. Cl.
*F04D 29/54* (2006.01)
*F04D 29/70* (2006.01)
(Continued)

(52) U.S. Cl.
CPC ..... *F04D 29/544* (2013.01); *F04D 29/54* (2013.01); *F04D 29/542* (2013.01);
(Continued)

(58) Field of Classification Search
CPC ..... F04D 29/54; F04D 29/542; F04D 29/544; F04D 29/667; F04D 29/703; F24F 1/0029; F24F 1/02; F24F 1/50; F24F 13/24
See application file for complete search history.

(56) References Cited

U.S. PATENT DOCUMENTS 7,811,055 B2 * 10/2010 Stommel ..... F01P 5/06 415/191
2003/0063987 A1 4/2003 Horng et al.
(Continued)

FOREIGN PATENT DOCUMENTS

JP 2000-130799 A 5/2000
JP 2008-261280 A 10/2008
(Continued)

OTHER PUBLICATIONS

International Search Report dated Jul. 12, 2016 in PCT/JP2016/061576, filed on Apr. 8, 2016.
(Continued)

*Primary Examiner* — Nathaniel E Wiehe
*Assistant Examiner* — Michael K. Reitz
(74) *Attorney, Agent, or Firm* — Oblon, McClelland, Maier & Neustadt, L.L.P.

(57) ABSTRACT

A fan includes an impeller including a boss that is a rotation center, and a plurality of blades that are provided on an outer peripheral surface of the boss; a motor and a motor fixing portion rotationally driving the impeller; a housing accommodating the impeller; a plurality of stationary blades disposed downstream of the impeller and connecting the motor fixing and the housing; and a connecting portion disposed between the housing and a rotation axis of the impeller, and extending in a rotation direction of the impeller and connecting the plurality of stationary blades. The connecting
(Continued)

100B portion has a recessed portion for passing wind that flows in a radial direction of the impeller.

14 Claims, 5 Drawing Sheets

(51) Int. Cl.

| | |
|---|---|
| ***F04D 29/66*** | (2006.01) |
| ***F24F 1/0029*** | (2019.01) |
| ***F24F 1/02*** | (2019.01) |
| ***F24F 1/50*** | (2011.01) |
| *F24F 13/24* | (2006.01) |

(52) U.S. Cl.
CPC ..... *F04D 29/667* (2013.01); *F04D 29/703* (2013.01); *F24F 1/0029* (2013.01); *F24F 1/02* (2013.01); *F24F 1/50* (2013.01); *F24F 13/24* (2013.01)

(56) References Cited

U.S. PATENT DOCUMENTS

| | | | | |
|---|---|---|---|---|
| 2003/0178180 | A1 | 9/2003 | Chang | |
| 2005/0186070 | A1 | 8/2005 | Zeng et al. | |
| 2009/0081036 | A1* | 3/2009 | Takeshita ..... | F04D 25/0613 415/208.2 |

FOREIGN PATENT DOCUMENTS

| | | | |
|---|---|---|---|
| JP | 2008-303778 | A | 12/2008 |
| JP | 2013-119816 | A | 6/2013 |
| WO | 2011/092751 | A1 | 8/2011 |

OTHER PUBLICATIONS

Office Action dated Oct. 25, 2018 in Australian Patent Application No. 2016304621.

Combined Office Action and Search Report dated Feb. 2, 2019 in Chinese Patent Application No. 201680045444.4 (with English translation and English translation of categories of cited documents).

Extended European Search Report dated Jul. 11, 2018 in European Patent Application No. 16834840.7, 10 pages.

Office Action dated Aug. 22, 2019 in corresponding Chinese Patent Application No. 201680045444.4 (with English Translation), 10 pages.

* cited by examiner

FAN AND AIR-CONDITIONING DEVICE

TECHNICAL FIELD

The present invention relates to a fan including stationary blades and to an air-conditioning device including the fan.

BACKGROUND ART

An axial flow fan and a diagonal flow fan include an impeller including a boss that is a rotation center and a plurality of blades that are provided at an outer peripheral surface of the boss. Hitherto, various structures thereof have been proposed. For example, Patent Literature 1 describes an axial flow fan including inner stationary blades that are connected to a base portion of a motor unit, outer stationary blades that are connected to an inner surface of a housing, and a ring-shaped connecting portion that connects the inner stationary blades and the outer stationary blades. In the axial flow fan described in Patent Literature 1, the blade width of each outer stationary blade is larger than the blade width of each inner stationary blade, and the inclination of each outer stationary blade with respect to a direction of a central axis is equal to the inclination of each inner stationary blade. In this way, when the blade width of each inner stationary blade is smaller than the blade width of each outer stationary blade, in a region away from the central axis, a component that swirls in a circumferential direction of air current is efficiently converted into a component in the direction of the central axis by the outer stationary blades, and, in a region close to the central axis, the influence of resistance that the air current is subjected to can be reduced. Therefore, a sufficient air collection effect is provided by the outer stationary blades, and interference of the inner stationary blades with the air current is suppressed, so that static pressure-air volume characteristics of the axial flow fan are improved.

CITATION LIST

Patent Literature

Patent Literature 1: Japanese Unexamined Patent Application Publication No. 2008-261280

SUMMARY OF INVENTION

Technical Problem

In general, when an axial flow fan is installed in a device having a large pressure loss, such as an air-conditioning device, in addition to a velocity component in a direction of a rotation axis of an impeller and a velocity component in a rotation direction, a velocity component in a radial direction occurs in air current that has passed the impeller. Therefore, when an axial flow fan including a ring-shaped connecting portion, such as that described in Patent Literature 1, is installed in an air-conditioning device, a blow-out air current including the velocity component in the radial direction collides with the connecting portion and disturbs a flow. This leads to a reduction in the blowing performance of the fan.

The present invention is made to overcome problems such as that described above, and has as its object the provision of a fan and an air-conditioning device that suppress a reduction in blowing performance.

Solution to Problem

A fan according to an embodiment of the present invention includes an impeller including a boss being a rotation center, and a plurality of blades provided on an outer peripheral surface of the boss; a motor unit configured to drive the impeller to rotate; a housing accommodating the impeller; a plurality of stationary blades disposed downstream of the impeller and connecting the motor unit and the housing; and a connecting portion disposed between the housing and a rotation axis of the impeller, and extending in a rotation direction of the impeller to connect the plurality of stationary blades, wherein the connecting portion has a recessed portion for passing wind that flows in a radial direction of the impeller.

Advantageous Effects of Invention

According to an embodiment of the present invention, when the connecting portion includes a recessed portion for passing wind, it is possible to suppress a reduction in the performance of the fan caused when air current that has passed the impeller and that includes a velocity component in a radial direction collides with the connecting portion.

DESCRIPTION OF EMBODIMENTS

A fan and an air-conditioning device of embodiments of the present invention are hereunder described by using the drawings. In the description below, descriptions of structural details, and the same or similar descriptions are simplified or omitted as appropriate.

Embodiment 1

Figure 1:
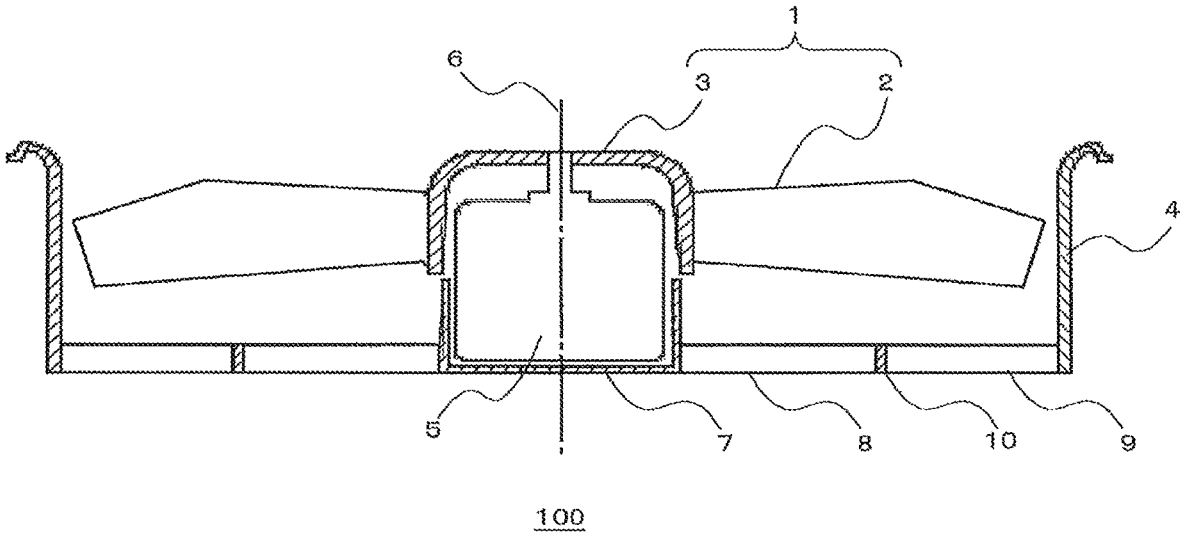
FIG. 1 is a sectional schematic view, formed by making a cut along a rotation axis, of a fan of Embodiment 1.

FIG. 1 is a sectional schematic view, formed by making a cut along a rotation axis 6, of a fan 100 of Embodiment 1 of the present invention. The fan 100 of Embodiment 1 is an axial flow fan that sends wind in a direction of the rotation axis 6. The fan 100 may be a diagonal flow fan or other types of fans.

As shown in FIG. 1, the fan 100 includes an impeller 1, a housing 4 that is disposed with a predetermined gap from an outer peripheral side of the impeller 1, a motor 5 for rotationally driving the impeller 1, a motor fixing portion 7 that supports the motor 5, a plurality of stationary blades (first stationary blades 8 and second stationary blades 9) for fixing the motor fixing portion 7 to the housing 4, and a connecting portion 10 for connecting the plurality of stationary blades.

The impeller 1 includes a boss 3 that is a rotation center of the impeller 1 and a plurality of blades 2 that are provided on an outer peripheral surface of the boss 3, and is accommodated in the housing 4 having a cylindrical inner peripheral surface. The boss 3 is connected to the motor 5. By driving force of the motor 5, the impeller 1 rotates around the rotation axis 6 and causes air to flow from an upper side to a lower side in the plane of FIG. 1. "Upstream" and "downstream" that are used in the description below refer to directions of flow of air caused by the impeller 1, and the upper side in the plane of FIG. 1 is "upstream", and the lower side in the plane of FIG. 1 is "downstream". The motor 5 is supported by the motor fixing portion 7 that is disposed on a downstream side of the boss 3. The motor fixing portion 7 is fixed to the housing 4 by the plurality of first stationary blades 8 and the second stationary blades 9 that are disposed on a downstream side of the impeller 1. The motor 5 and the motor fixing portion 7 correspond to "motor unit" according to the present invention.

Air current that has passed the impeller 1 includes a velocity component in a rotation direction. The first stationary blades 8 and the second stationary blades 9 that are disposed on the downstream side of the impeller 1 convert the velocity component in the rotation direction into a velocity component in a direction of the rotation axis, and improve the blowing performance of the fan 100. On an inner peripheral side and an outer peripheral side, the plurality of first stationary blades 8 and second stationary blades 9 have substantially the same height in the direction of the rotation axis 6.

Figure 2:
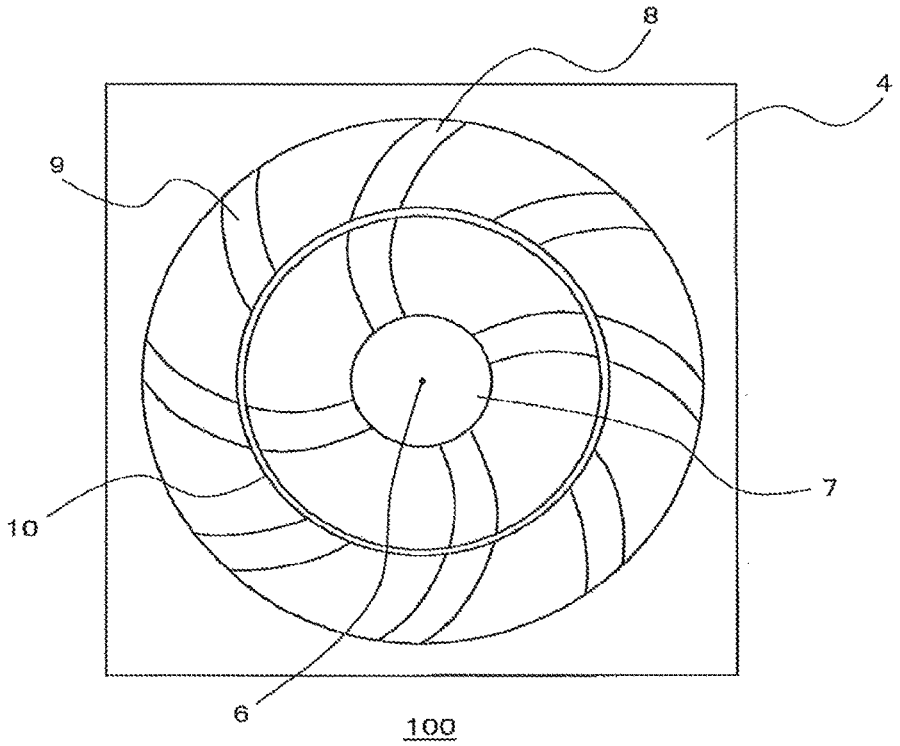
FIG. 2 is a plan view of the fan of Embodiment 1 when viewed from a downstream side.

FIG. 2 is a plan view of the fan 100 of Embodiment 1 when viewed from the downstream side. As shown in FIG. 2, the first stationary blades 8 extend from an outer peripheral surface of the motor fixing portion 7, and are connected to the inner peripheral surface of the housing 4. At portions between the first stationary blades 8, the second stationary blades 9 extend from an outer peripheral surface of the connecting portion 10 and are connected to the inner peripheral surface of the housing 4. That is, the second stationary blades 9 are disposed at locations that are shifted from the first stationary blades 8 in the rotation direction when viewed from the direction of the rotation axis, and extend from an inner periphery of the housing 4 towards the rotation axis and up to an intermediate portion between an inside of the housing 4 and the rotation axis 6. The first stationary blades 8 and the second stationary blades 9 each have a substantially arc shape, and have substantially a certain thickness.

Although, in FIG. 2, four first stationary blades 8 and four second stationary blades 9 are provided, the number of first stationary blades 8 and the number of second stationary blades 9 are not limited thereto. The number of first stationary blades 8 and the number of second stationary blades 9 may be five or more or three or less. Although, in FIG. 2, the first stationary blades 8 and the second stationary blades 9 are alternately disposed in the rotation direction, various other structures, such as a structure in which a second stationary blade 9 is not disposed between any two first stationary blades 8 or a structure in which two second stationary blades 9 are disposed between first stationary blades 8, may be used.

The connecting portion 10 connects the first stationary blades 8 and the second stationary blades 9, is disposed between the inner periphery of the housing 4 and the rotation axis 6, and is formed of a ring-shaped (annular) thin plate that extends in the rotation direction of the impeller 1. The radius of an upstream end of the connecting portion 10 and the radius of a downstream end of the connecting portion 10 are substantially the same. An inner peripheral side and an outer peripheral side of the connecting portion 10 need not be sides parallel to the rotation axis 6. For example, they may be sides that at an intermediate portion in the direction of the rotation axis are gently uneven with respect to the rotation axis 6. The connecting portion 10 may be formed of a thin plate having different radial thicknesses in the direction of the rotation axis. The upstream end and the downstream end of the connecting portion 10 may be thinner than the intermediate portion in the direction of the rotation axis. Alternatively, the upstream end and the downstream end of the connecting portion 10 may be round. This makes it possible to reduce the resistance with respect to wind that flows along the connecting portion 10 from an upstream side to a downstream side.

Figure 3:
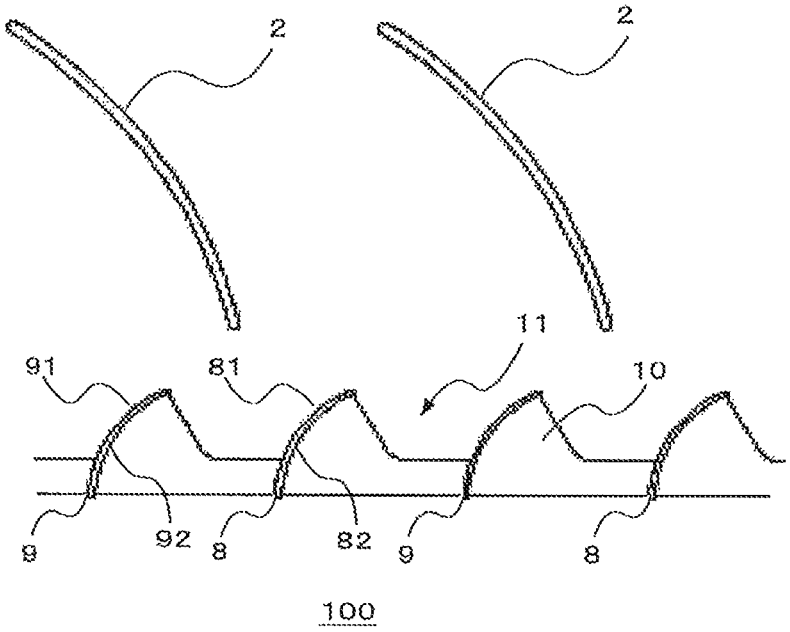
FIG. 3 is a plan development of a cylindrical cross section of the fan at a radial position where a connecting portion of Embodiment 1 is disposed.

FIG. 3 is a plan development of a cylindrical cross section of the fan 100 at a radial position where the connecting portion 10 according to Embodiment 1 is disposed. As shown in FIG. 3, the blades 2 of the impeller 1, which are moving blades, include blade elements that advance and retreat with respect to the rotation direction of the impeller 1 at a predetermined angle from an inner peripheral side to an outer peripheral side. Blade elements of the first stationary blades 8 and the second stationary blades 9 are shaped to advance and retreat at an angle that is opposite to the angle of the blade elements of the blades 2 with respect to the rotation direction from the inner peripheral side to the outer peripheral side.

As shown in FIG. 3, the first stationary blades 8 and the second stationary blades 9 are disposed on the same plane that perpendicularly intersects the rotation axis 6 on the downstream side of the impeller 1. The first stationary blades 8 each include a suction surface 81 and a pressure surface 82. The second stationary blades 9 each include a suction surface 91 and a pressure surface 92. The suction surfaces 81 and 91 are inclined surfaces facing an upstream (suction) side. The pressure surfaces 82 and 92 are inclined surfaces facing a downstream (blowout) side. The connecting portion 10 connects the pressure surface of one of the two types of stationary blades and the suction surface of the other of the two types of stationary blades. More specifically, the connecting portion 10 connects the pressure surface 92 of each second stationary blade 9 and the corresponding suction surface 81 of each first stationary blade 8; and connects the pressure surface 82 of each first stationary blade 8 and the corresponding suction surface 91 of each second stationary blade 9.

Portions of the connecting portion 10 on the upstream side and between the first stationary blades 8 and the second stationary blades 9 are cut out. In other words, the connecting portion 10 includes recessed portions 11 that are recessed towards the downstream side from a plane extending through upstream ends of the first stationary blades 8 and upstream ends of the second stationary blades 9. The recessed portions 11 are formed by the upstream ends of the first stationary blades 8, the upstream end of the connecting portion 10, and the upstream ends of the second stationary blades 9. Whereas the downstream end of the connecting portion 10 is disposed on a plane perpendicular to the rotation axis 6, the upstream end is bent or curved towards the downstream side. The connecting portion 10 is connected to the pressure surfaces 82 of the first stationary blades 8 and the pressure surfaces 92 of the second stationary blades 9 over substantially the entire length in an axial direction, that is, from the upstream end to the downstream end; and is connected to the suction surfaces 81 of the first stationary blades 8 and the suction surfaces 91 of the second stationary blades 9 only at partial regions including the downstream end. That is, whereas the connecting portion 10 connects downstream ends of the pressure surfaces 82 of the first stationary blades 8 and downstream ends of the suction surfaces 91 of the second stationary blades 9, the connecting portion 10 does not connect upstream ends of the pressure surfaces 82 of the first stationary blades 8 and upstream ends of the suction surfaces 91 of the second stationary blades 9.

Although it is desirable to provide the recessed portions 11 of the connecting portion 10 on the upstream side, the recessed portions 11 may be formed on the downstream side of the connecting portion 10 depending upon the arrangement of the first stationary blades 8 and the second stationary blades 9. In this case, the recessed portions 11 that are recessed towards the upstream side from a plane extending through downstream ends of the first stationary blades 8 and downstream ends of the second stationary blades 9 are formed by the downstream ends of the first stationary blades 8, the downstream end of the connecting portion 10, and the downstream ends of the second stationary blades 9. The upstream end of the connecting portion 10 is situated on a plane perpendicular to the rotation axis 6, and the downstream end thereof is bent or curved towards the downstream side. The connecting portion 10 is connected to the pressure surfaces 82 of the first stationary blades 8 and the pressure surfaces 92 of the second stationary blades 9 over substantially the entire length in the direction of the rotation axis; and is connected to the suction surfaces 81 of the first stationary blades 8 and the suction surfaces 91 of the second stationary blades 9 only at partial regions including the upstream end. That is, whereas the connecting portion 10 connects the upstream ends of the pressure surfaces 82 of the first stationary blades 8 and the upstream ends of the suction surfaces 91 of the second stationary blades 9, the connecting portion 10 does not connect the downstream ends of the pressure surfaces 82 of the first stationary blades 8 and the downstream ends of the suction surfaces 91 of the second stationary blades 9. Alternatively, the connecting portion 10 may be connected to the suction surfaces 81 of the first stationary blades 8 and the suction surfaces 91 of the second stationary blades 9 over substantially the entire length in the direction of the rotation axis; and may be connected to the pressure surfaces 82 of the first stationary blades 8 and the pressure surfaces 92 of the second stationary blades 9 only at partial regions including the upstream end or the downstream end.

Next, the advantages of the fan 100 according to Embodiment 1 are described. The fan 100 is used by being installed in an air-conditioning device or other such devices; and it is desirable that the fan 100 be thinly made in terms of a device setting space. Therefore, it is desirable that the heights of the first stationary blades 8 and the second stationary blades 9 of the fan 100 in the direction of the rotation axis be suppressed.

The blowing performance of a blade row is brought into association by a chord-pitch ratio $\sigma=L/t$, which is defined by a chord length L and an interval t between adjacent blades. Here, the chord length L is the length of a straight line connecting a leading edge and a trailing edge of a blade. It is known that, in general, blade rows having geometric similarity in which the chord-pitch ratio $\sigma$ is a specific value provides substantially the same blowing performance. That is, to achieve a desired blowing performance by blades whose chord length L is small, that is, blades whose heights are suppressed, the number of blades is increased and the interval t between adjacent blades is reduced.

Here, to achieve a desired blowing performance by suppressing the heights of the stationary blades, the number of stationary blades that is connected to the motor fixing portion 7 should be increased. Since there are strength and manufacturing restrictions, when the number of stationary blades is increased, air passages between the blades on an inner peripheral side of the stationary blades are blocked, as a result of which the blowing performance is reduced.

In contrast, in Embodiment 1, as shown in FIG. 2, the first stationary blades 8 and the second stationary blades 9 are both disposed on the outer peripheral side of the impeller 1, and only the first stationary blades 8 are disposed on the inner peripheral side of the impeller 1. That is, since the number of stationary blades is large on the outer peripheral side of the impeller 1, a desired blowing performance is achieved while suppressing the heights of the stationary blades. Since the number of stationary blades is small on the inner peripheral side of the impeller 1, a reduction in the blowing performance caused by the blockage of the air passages on the inner peripheral side does not occur.

The blade elements of the stationary blades are disposed at a predetermined angle in the rotation direction from the inner peripheral side towards the outer peripheral side. That is, the stationary blades each have a substantially arc shape, and have substantially the same thickness. Therefore, it is difficult to increase the strengths of the stationary blades. When the motor fixing portion 7 and the housing 4 are to be connected to each other by the stationary blades, the stationary blades need to have strength for supporting the motor 5, which is a heavy object. Therefore, in Embodiment 1, the strength is increased by connecting the plurality of first stationary blades 8 and second stationary blades 9 by the connecting portion 10. This suppresses breakage of the first stationary blades 8 and the second stationary blades 9 that support the motor fixing portion 7, the breakage being caused by vibration that is generated when rotationally driving the impeller 1.

The connecting portion 10 that connects the first stationary blades 8 and the second stationary blades 9 connects the suction surface of one of the two types of stationary blades and the pressure surfaces of the other of the two types of stationary blades, the two types of stationary blades being the first stationary blades 8 and the second stationary blades 9. The connecting portion 10 includes the recessed portions 11 formed by cutting out portions thereof on the upstream side. In general, when the fan 100 is installed in a device having a large pressure loss, such as an air-conditioning device, in addition to a velocity component in a direction parallel to the rotation axis 6 and the velocity component in the rotation direction of the impeller 1, a velocity component in a radial direction from the inner peripheral side to the outer peripheral side of the impeller 1 occurs in air current that has passed the impeller 1. Wind that passes the impeller 1 and that flows in the radial direction collides with the connecting portion 10 extending in the rotation direction. At this time, since the connecting portion 10 according to Embodiment 1 includes the recessed portions 11 for passing the wind in the radial direction, the area of the collision of the wind with the connecting portion 10 becomes small. That is, when the recessed portions 11 are formed on the upstream side of the connecting portion 10, the wind generated at the blades 2 can easily move in the radial direction even at a portion where the connecting portion 10 is formed.

This makes it possible to reduce air current turbulence generated when the air current that has passed the impeller 1 collides with the connecting portion 10, and to suppress a reduction in the blowing performance caused by the connecting portion 10 while maintaining the strengths of the first stationary blades 8 and the second stationary blades 9.

It is desirable that each recessed portion 11 has a certain size in terms of improving the blowing performance. It is desirable that the connecting portion 10 have a certain width in the direction of the rotation axis in terms of the strengths of the first stationary blades 8 and the second stationary blades 9. In Embodiment 1, by forming the upstream end of the connecting portion 10 with a bent shape to be recessed towards the downstream side, the recessed portions 11 that are large are formed while maintaining the widths of connection portions with the first stationary blades 8 or the second stationary blades 9. This makes it possible to further improve the blowing performance of the fan 100.

The connecting portion 10 is connected to only a partial region from the upstream end to the downstream end of each suction surface or each pressure surface of at least one of the first stationary blade 8 and the second stationary blade 9. Therefore, since the recessed portions 11 each include a surface connected to only a partial region, wind that flows along the suction surface or the pressure surface flows easily. When a side that is connected to only the corresponding partial region is connected at a portion whose width is less than or equal to half of the width of the corresponding first stationary blade 8 and the width of the corresponding second stationary blade 9 in the direction of the rotation axis, each recessed portion 11 can be made large, and the blowing performance can be further improved.

In Embodiment 1, the connecting portion 10 is connected to the pressure surface 92 of each second stationary blade 9 at a region including the upstream end. In this way, since the second stationary blades 9 extending partway towards the rotation axis 6 are such that the upstream ends receiving a strong wind from the blades 2 are connected at the connecting portion 10, the strengths of the second stationary blades 9 are increased and vibration and noise are reduced. In particular, as shown in FIG. 3, when the connecting portion 10 is connected from the upstream end to the downstream end of the pressure surface 92 of each second stationary blade 9, this effect is further increased.

The pressure surface of each stationary blade is a surface that is inclined and faces the downstream side. When the connecting portion 10 is connected to the downstream side of each pressure surface, undercuts, which are shadow portions from the upstream side and from the downstream side, may be formed between the pressure surfaces and the connecting portion 10. In contrast, the connecting portion 10 according to Embodiment 1 is connected to regions including the upstream ends of the pressure surfaces of the first stationary blades 8 and the second stationary blades 9. The connecting portion 10 has its upstream side cut out on a suction-surface side of the first stationary blades 8 or the second stationary blades 9. Therefore, the connection portions with the first stationary blades 8 or the second stationary blades 9 do not become undercut portions. Consequently, when the housing 4, the first stationary blades 8, the second stationary blades 9, and the motor fixing portion 7 are integrally molded by injection molding using resin, it is possible to simplify the structure of a die and to manufacture the fan 100 at a low cost.

Embodiment 2

Next, Embodiment 2 of the present invention is described. A fan 100A of Embodiment 2 differs from Embodiment 1 in the form of a connecting portion 10A. In Embodiment 2, points that are not particularly specified are described as being the same as those of Embodiment 1, and the same functions and structures are given the same reference numerals and described.

Figure 4:
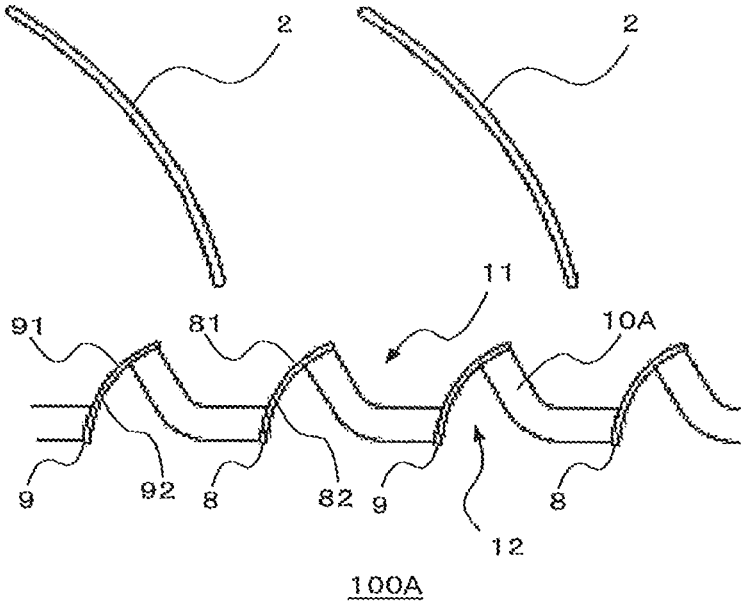
FIG. 4 is a plan development of a cylindrical cross section of a fan at a radial position where a connecting portion of Embodiment 2 is disposed.

FIG. 4 is a plan development of a cylindrical cross section of the fan 100A at a radial position where the connecting portion 10A of Embodiment 2 is disposed. As shown in FIG. 4, the connecting portion 10A of Embodiment 2 has a cutout structure on both an upstream side and a downstream side. In other words, on the upstream side, the connecting portion 10A includes recessed portions 11 that are similar to those of Embodiment 1; and, on the downstream side, the connecting portion 10A includes recessed portions 12 that are recessed towards the upstream side from a plane extending through downstream ends of first stationary blades 8 and downstream ends of second stationary blades 9. The recessed portions 11 are formed by upstream ends of the first stationary blades 8, an upstream end of the connecting portion 10, and upstream ends of the second stationary blades 9; and the recessed portions 12 are formed by the downstream ends of the first stationary blades 8, a downstream end of the connecting portion 10, and the downstream ends of the second stationary blades 9. The upstream end and the downstream end of the connecting portion 10 are not disposed on a plane perpendicular to a rotation axis 6, and are bent or curved towards the downstream side or the upstream side. The connecting portion 10A is connected to pressure surfaces 82 of the first stationary blades 8 and pressure surfaces 92 of the second stationary blades 9 only at partial regions including the upstream end, and is connected to suction surfaces 81 of the first stationary blades 8 and suction surfaces 91 of the second stationary blades 9 only at partial regions including the downstream end.

By such a structure, it is possible to further reduce the area of collision of air current passing an impeller 1 and moving in a radial direction with the connecting portion 10A, and to further suppress a reduction in the blowing performance of the fan 100A. When a downstream side of the suction surface 81 of each first stationary blade 8 or a downstream side of the suction surface 91 of each second stationary blade 9 is connected to an upstream side of the pressure surface 82 of each first stationary blade 8 or an upstream side of the pressure surface 92 of each second stationary blade 9, connection portions of the connecting portion 10A with the first stationary blades 8 and the second stationary blades 9 do not become undercut portions. Therefore, when a housing 4, the first stationary blades 8, the second stationary blades 9, and a motor fixing portion 7 are integrally molded by injection molding using resin, it is possible to simplify the structure of a die and to manufacture the fan 100A at a low cost.

The connecting portion 10A may be connected to the pressure surfaces 82 of the first stationary blades 8 and the pressure surfaces 92 of the second stationary blades 9 only at partial regions including the downstream end; and may be connected to the suction surfaces 81 of the first stationary blades 8 and the suction surfaces 91 of the second stationary blades 9 only at partial regions including the upstream end.

Embodiment 3

Next, Embodiment 3 of the present invention is described. A fan 100B of Embodiment 3 differs from Embodiment 1 in the structure of connecting portions 10B. In Embodiment 3, points that are not particularly specified are described as being the same as those of Embodiment 1, and the same functions and structures are given the same reference numerals and described.

Figure 5:
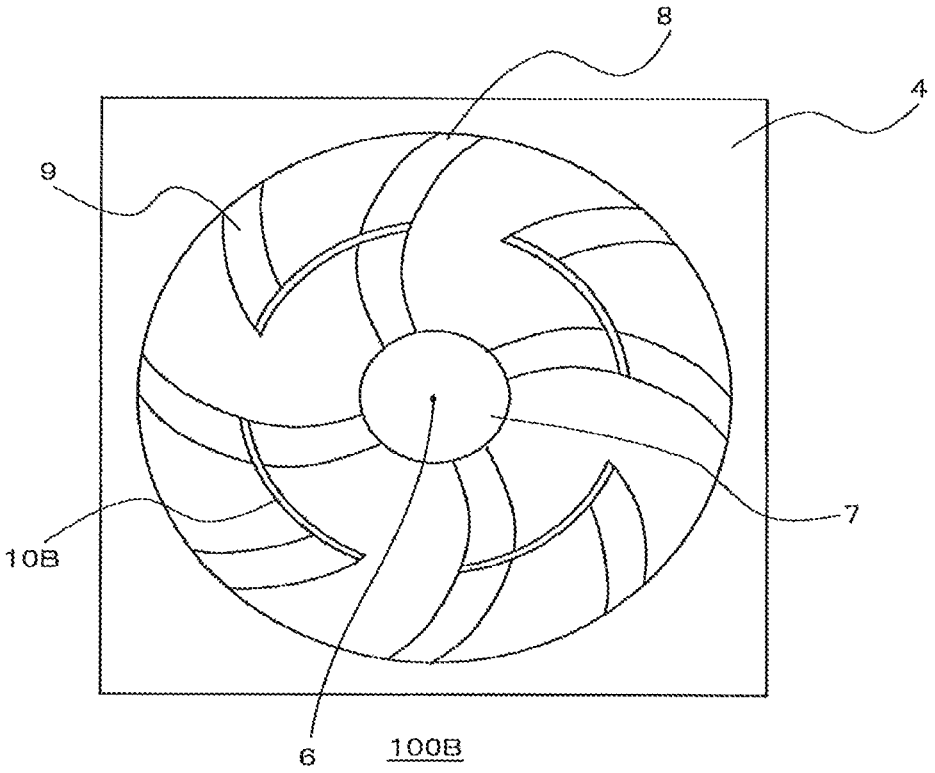
FIG. 5 is a plan view of a fan of Embodiment 3 when viewed from a downstream side.
Figure 6:
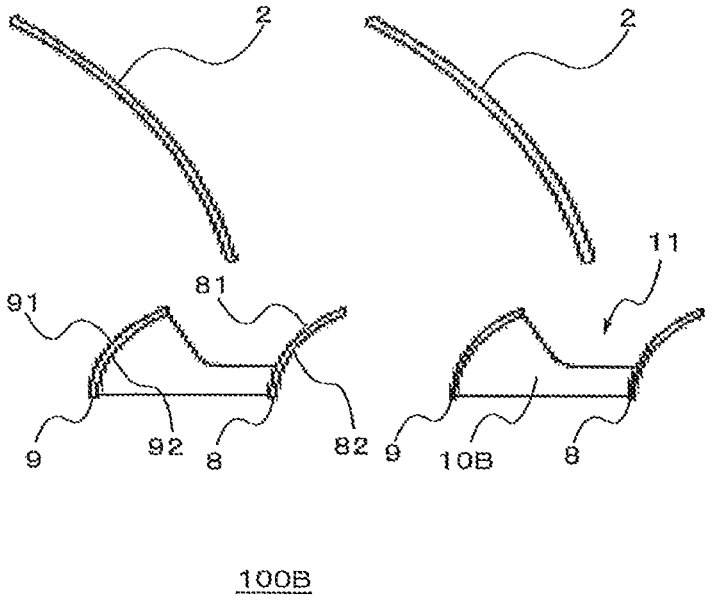
FIG. 6 is a plan development of a cylindrical cross section of the fan at a radial position where the connecting portion of Embodiment 3 is disposed.

FIG. 5 is a plan view of the fan 100B of Embodiment 3 when viewed from a downstream side. FIG. 6 is a plan development of a cylindrical cross section of the fan 100B at radial positions where the connecting portions 10B of Embodiment 3 are disposed. As shown in FIG. 5, in Embodiment 3, four connecting portions 10B having an arc shape in plan view are disposed in a ring shape between a housing 4 and a rotation axis 6. The connecting portions 10B each connect one first stationary blade 8 and one second stationary blade 9. As shown in FIG. 6, each connecting portion 10B connects a pressure surface 92 of its corresponding second stationary blade 9 and a suction surface 81 of its corresponding first stationary blade 8. Each connecting portion 10B does not connect a suction surface 91 of its corresponding second stationary blade 9 and a pressure surface 82 of its corresponding first stationary blade 8. Recessed portions 11 similar to those in Embodiment 1 are formed on an upstream side of the connecting portions 10B.

By separately disposing the connecting portions 10B in this way, it is possible to reduce the area of collision of air current that has passed an impeller 1 with the connecting portions 10B. As a result, it is possible to further suppress a reduction in the blowing performance caused when air current that has passed the impeller 1 collides with the connecting portions 10.

Embodiment 4

Next, Embodiment 4 of the present invention is described. A fan 100C of Embodiment 4 differs from Embodiment 1 in the arrangement of first stationary blades 8 and second stationary blades 9, and in the structure of connecting portions 10C. In Embodiment 4, points that are not particularly specified are described as being the same as those of Embodiment 1, and the same functions and structures are given the same reference numerals and described.

Figure 7:
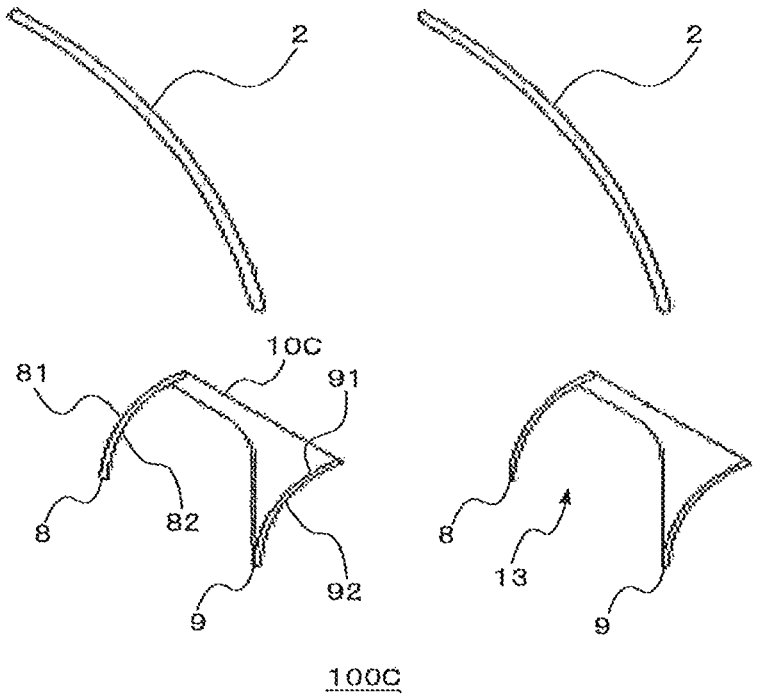
FIG. 7 is a plan development of a cylindrical cross section of a fan at a radial position where a connecting portion of Embodiment 4 is disposed.

FIG. 7 is a plan development of a cylindrical cross section of the fan 100C at radial positions where the connecting portions 10C of Embodiment 4 are disposed. As shown in FIG. 7, in Embodiment 4, the second stationary blades 9 are disposed on a downstream side of the first stationary blades 8. The connecting portions 10C of Embodiment 4 are separately disposed as in Embodiment 3, and each connect a pressure surface 82 of its corresponding first stationary blade 8 and a suction surface 91 of its corresponding second stationary blade 9.

Portions of the connecting portion 10C on a downstream side are cut out. In other words, each connecting portion 10C includes a recessed portion 13 that is recessed towards an upstream side from a plane extending through a downstream end of its corresponding first stationary blade 8 and a downstream end of its second stationary blade 9. The recessed portions 13 are formed by the downstream ends of the first stationary blades 8, downstream ends of the connecting portions 10C, and the downstream ends of the second stationary blades 9. Upstream ends of the connecting portions 10C are disposed on a plane extending through upstream ends of the first stationary blades 8 and upstream ends of the second stationary blades 9, and the downstream ends thereof are bent or curved towards an upstream side. Each connecting portion 10C is connected to the pressure surface 82 of its corresponding first stationary blade 8 only at a partial region including the upstream end, and is connected to the suction surface 91 of its corresponding second stationary blades 9 over substantially the entire length in a direction of a rotation axis. That is, whereas the connecting portions 10C connect upstream ends of the pressure surfaces 82 of the first stationary blades 8 and upstream ends of the suction surfaces 91 of the second stationary blades 9, the connecting portions 10C do not connect downstream ends of the pressure surfaces 82 of the first stationary blades 8 and downstream ends of the suction surfaces 91 of the second stationary blades 9.

Although, in the example in FIG. 7, the second stationary blades 9 are disposed downstream from the first stationary blades 8, the first stationary blades 8 may be disposed downstream from the second stationary blades 9. Each connecting portion 10C may be connected to the pressure surface 82 of its corresponding first stationary blade 8 over substantially the entire length in the direction of the rotation axis, and may be connected to the suction surface 91 of its corresponding second stationary blade 9 only at a partial region including an upstream end.

When air current flows into a blade row, flow separation at a leading edge of a blade or the development of a velocity boundary layer at a blade surface causes a practical air passage width between blades to be reduced. Due to the blocking effect between the blades, when a blade row having a large number of blades and a narrow air passage width between the blades is used, the blowing performance is reduced.

In contrast, in Embodiment 4, by disposing the second stationary blades 9 downstream from the first stationary blades 8, it is possible to ensure an air passage width between blades on an outer peripheral side of an impeller 1 where the first stationary blades 8 and the second stationary blades 9 are disposed. Since, on a downstream side of air current that passes the impeller 1, the second stationary blades 9 are disposed between the first stationary blades 8, it is possible to convert a velocity component in a rotation direction into a velocity component in the direction of the rotation axis by the first stationary blades 8 and the second stationary blades 9. This makes it possible to suppress a reduction in the blowing performance caused by the blocking effect between blades and to improve the blowing performance of the fan 100C.

Embodiment 5

Next, Embodiment 5 of the present invention is described. Embodiment 5 corresponds to an air-conditioning device 500 including the fan 100 of Embodiment 1. In Embodiment 5, points that are not particularly specified are described as being the same as those of Embodiment 1, and the same functions and structures are given the same reference numerals and described.

Figure 8:
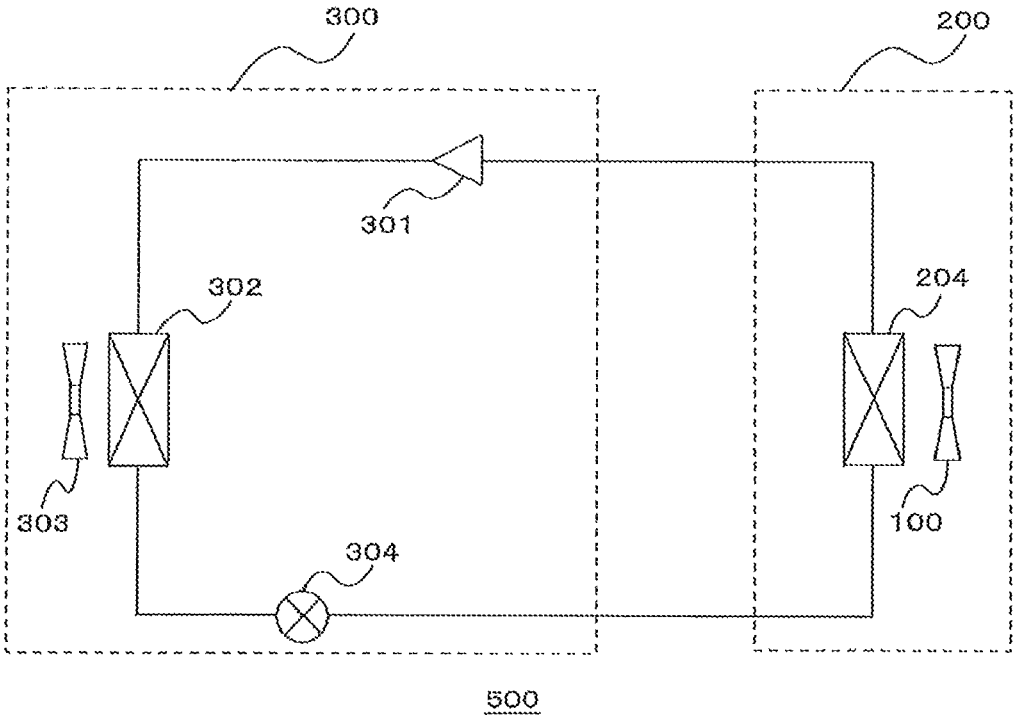
FIG. 8 is a schematic structural view of an air-conditioning device of Embodiment 5.

FIG. 8 is a schematic structural view of the air-conditioning device 500 of Embodiment 5. As shown in FIG. 8, the air-conditioning device 500 includes an outdoor unit 300 and an indoor unit 200. In Embodiment 5, an example in which the fan 100 of Embodiment 1 is used in the indoor unit 200 of the air-conditioning device 500 is indicated. The outdoor unit 300 includes a compressor 301, an outdoor-side heat exchanger 302, a fan 303, and expanding means 304. The indoor unit 200 includes an indoor-side heat exchanger 204 and the fan 100. The compressor 301, the outdoor-side heat exchanger 302, the expanding means 304, and the indoor-side heat exchanger 204 are connected to each other by pipes, and form a refrigerant circuit. By circulating refrigerant in the refrigerant circuit, air-conditioning is performed on a region to be air-conditioned.

Figure 9:
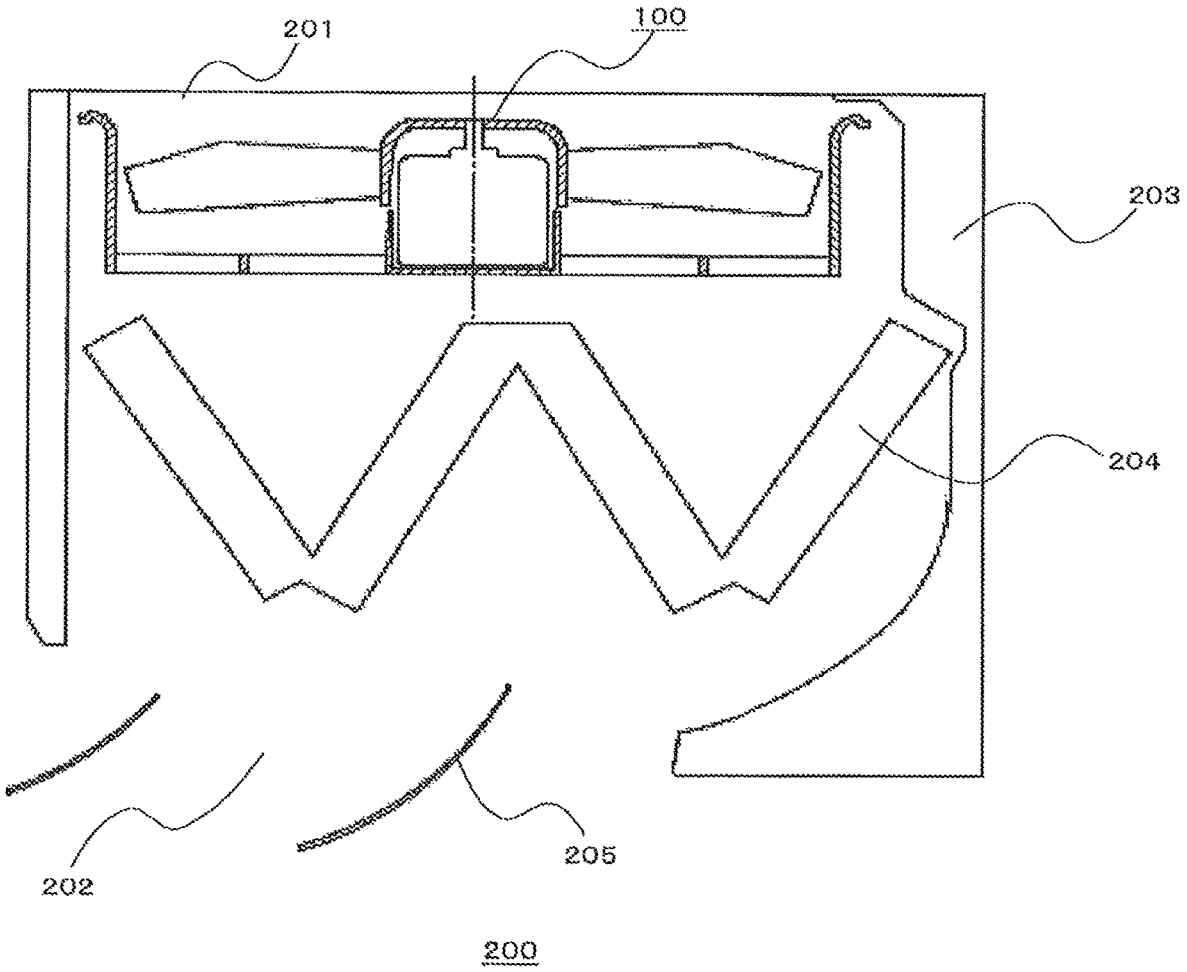
FIG. 9 is a sectional schematic view of an exemplary indoor unit of the air-conditioning device of Embodiment 5.

FIG. 9 is a sectional schematic view of the exemplary indoor unit 200 of the air-conditioning device 500 of Embodiment 5. In FIG. 9, the left side in the plane of FIG. 9 is the front side of the indoor unit 200. The indoor unit 200 includes a housing 203, the fan 100, and the indoor-side heat exchanger 204. The housing 203 has an air inlet 201 for sucking indoor air therein and an air outlet 202 for supplying air-conditioning air to a region to be air-conditioned. The fan 100 is accommodated in the housing 203 and sucks in the indoor air from the air inlet 201 and blows out the air-conditioning air from the air outlet 202. The indoor-side heat exchanger 204 is disposed from the fan 100 to the air outlet 202, and performs heat-exchange between the refrigerant and the indoor air to produce the air-conditioning air.

The air inlet 201 opens in an upper portion of the housing 203. The air outlet 202 opens in a lower portion of the housing 203 (more specifically, a lower side of a front surface portion of the housing 203). Further, a mechanism that controls a blowing out direction of air current, such as vanes 205, is provided at the air outlet 202. The fan 100 is disposed downstream from the air inlet 201 and is disposed upstream from the indoor-side heat exchanger 204. Although FIG. 9 shows a structure in which the indoor unit 200 includes one fan 100, a plurality of fans 100 may be disposed in a row in a longitudinal direction of the housing 203 (up-down direction in the plane of FIG. 9) in accordance with, for example, air flow required for the indoor unit 200.

The indoor air is taken into the indoor unit 200 from the air inlet 201 formed in the upper portion of the housing 203 by the fan 100, and is supplied to the indoor-side heat exchanger 204. When the indoor air passes the indoor-side heat exchanger 204, heat exchange is performed between the indoor air and the refrigerant, so that the indoor air is heated or cooled and becomes the air-conditioning air. The air-conditioning air flows out to the region to be air-conditioned from the air outlet 202 formed in the lower portion of the housing 203.

In the indoor unit 200 according to Embodiment 5, since the fan 100 in Embodiment 1 is used, even if the indoor unit 200 having a high pressure loss is caused to pass air-conditioning air, it is possible to reduce air current turbulence caused by a velocity component in a radial direction, and to suppress a reduction in the blowing performance. As a result, it is possible to improve the power efficiency of the indoor unit 200 and the air-conditioning device 500.

Although Embodiments 1 to 5 according to the present invention are described above with reference to the drawings, specific structures of the present invention are not limited thereto. Changes can be made within a range that does not depart from the gist of the present invention. For example, the structures and shapes of the stationary blades of the fan 100 are not limited to those according to Embodiments 1 to 5, so that the connecting portion 10 can be used for connecting stationary blades having various shapes. More specifically, although, in Embodiments 1 to 5 above, the first stationary blades 8 extend to the inner peripheral surface of the housing 4 from the outer peripheral surface of the motor fixing portion 7, the first stationary blades 8 may extend to an inner peripheral surface of the connecting portion 10 from the outer peripheral surface of the motor fixing portion 7. Alternatively, the fan 100 may include only first stationary blades 8, and the connecting portion 10 may connect the plurality of first stationary blades 8.

The structures in Embodiments 1 to 5 above may be combined as appropriate. For example, the form of the connecting portion 10B of Embodiment 3 may be the same as the form of the connecting portion 10A of Embodiment 2. Alternatively, any one of the fan 100A of Embodiment 2 to the fan 100C of Embodiment 4 may be used in the indoor unit 200 of Embodiment 5. The fan 303 of the outdoor unit 300 may be any one of the fan 100 of Embodiment 1 to the fan 100C of Embodiment 4.

REFERENCE SIGNS LIST

1 impeller 2 blade 3 boss 4, 203 housing 5 motor 6 rotation axis 7 motor fixing portion 8 first stationary blade 9 second stationary blade 10, 10A, 10B, 10C connecting portion 11, 12, 13 recessed portion 81, 91 suction surface 82, 92 pressure surface 100, 100A, 100B, 100C, 303 fan 200 indoor unit 201 air inlet 202 air outlet 204 indoor-side heat exchanger 205 vane 300 outdoor unit 301 compressor 302 outdoor-side heat exchanger 304 expanding means 500 air-conditioning device

The invention claimed is:

1. A fan comprising:

an impeller including a boss being a rotation center, and a plurality of blades provided on an outer peripheral surface of the boss;

a motor unit configured to drive the impeller to rotate;

a housing accommodating the impeller;

a plurality of stationary blades disposed downstream of the impeller and connecting the motor unit and the housing; and a connecting portion disposed between the housing and a rotation axis of the impeller, and extending in a rotation direction of the impeller to connect the plurality of stationary blades, wherein the connecting portion is divided in the rotation direction, each divided connecting portion connects two of the plurality of stationary blades which are adjacent in the rotation direction to make a plurality of pairs of the connected stationary blades, wherein no connecting portion is provided in the rotation direction between the pairs of the stationary blades, and wherein the connecting portion has a recessed portion for passing wind that flows in a radial direction of the impeller.

2. The fan of claim 1, wherein an upstream end of the connecting portion is bent or curved towards a downstream side, or a downstream end of the connecting portion is bent or curved towards an upstream side.

3. The fan of claim 1, wherein the plurality of stationary blades include a first stationary blade extending from the housing to the motor unit; and a second stationary blade is disposed at a location shifted from the first stationary blade in the rotation direction and extending from the housing to the connecting portion.

4. The fan of claim 3, wherein the recessed portion is formed at an upstream side of the connecting portion by an upstream end of the first stationary blade, an upstream end of the connecting portion, and an upstream end of the second stationary blade, and is recessed towards a downstream side from a plane extending through the upstream end of the first stationary blade and the upstream end of the second stationary blade, or wherein the recessed portion is formed at a downstream side of the connecting portion by a downstream end of the first stationary blade, a downstream end of the connecting portion, and a downstream end of the second stationary blade, and is recessed towards an upstream side from a plane extending through the downstream end of the first stationary blade and the downstream end of the second stationary blade.

5. The fan of claim 3, wherein a plurality of the second stationary blades are disposed between a plurality of the first stationary blades, and wherein the connecting portion connects a suction surface of each first stationary blade or a suction surface of each second stationary blade to a pressure surface of a corresponding one of the first stationary blades that is adjacent thereto or a pressure surface of a corresponding one of the second stationary blades that is adjacent thereto.

6. The fan of claim 3, wherein the connecting portion is connected to only a partial region from an upstream end to a downstream end of a suction surface or a pressure surface of at least one of the first stationary blade and the second stationary blade.

7. The fan of claim 3, wherein the connecting portion is connected to a region including an upstream end of a pressure surface of at least one of the first stationary blade and the second stationary blade.

8. The fan of claim 3, wherein the connecting portion is connected to a region including an upstream end of a pressure surface of the second stationary blade and a region including a downstream end of a suction surface of the first stationary blade.

9. The fan of claim 8, wherein the connecting portion is connected from the upstream end to a downstream end of the pressure surface of the second stationary blade.

10. The fan of claim 8, wherein the connecting portion is connected to only a partial region including the upstream end of the pressure surface of the second stationary blade.

11. The fan of claim 3, wherein the connecting portion is connected to a region including an upstream end of a pressure surface of the first stationary blade and a region including a downstream end of a suction surface of the second stationary blade.

12. The fan of claim 3, wherein the first stationary blade and the second stationary blade are disposed at locations that differ from each other in a direction of the rotation axis of the impeller, and wherein the connecting portion is connected to a region including an upstream end of a pressure surface of the first stationary blade or the second stationary blade that is positioned on an upstream side.

13. An air-conditioning device comprising:

a fan including an impeller including a boss being a rotation center, and a plurality of blades provided on an outer peripheral surface of the boss, a motor unit configured to rotationally drive the impeller, a housing accommodating the impeller, a plurality of stationary blades disposed downstream of the impeller and connecting the motor unit and the housing, and a connecting portion disposed between the housing and a rotation axis of the impeller, and extending in a rotation direction of the impeller and connecting the plurality of stationary blades; and a heat exchanger that performs heat exchange of air supplied by the fan, wherein the connecting portion is divided in the rotation direction, each divided connecting portion connects two of the plurality of stationary blades which are adjacent in the rotation direction to make a plurality of pairs of the connected stationary blades, wherein no connecting portion is provided in the rotation direction between the pairs of the stationary blades, and wherein the connecting portion has a recessed portion for passing wind that flows in a radial direction of the impeller.

14. The fan of claim 3, wherein the connecting portion is connected from an upstream end to a downstream end of a pressure surface of the second stationary blade, and is connected only to a region including a downstream end of a suction surface of the first stationary blade.

* * * * *